US006045418A

United States Patent [19]

Roos

[11] Patent Number: 6,045,418

[45] Date of Patent: Apr. 4, 2000

[54] MARINE JET DRIVE

[76] Inventor: Paul W. Roos, 2033-F W. McNab Rd., Pompano Beach, Fla. 33069

[21] Appl. No.: 09/028,735

[22] Filed: Feb. 24, 1998

Related U.S. Application Data

[62] Division of application No. 08/456,188, May 31, 1995, Pat. No. 5,720,635, which is a division of application No. 07/699,336, May 13, 1991, Pat. No. 5,421,753.

[51] Int. Cl.[7] ..... B63H 11/00

[52] U.S. Cl. ..... 440/38; 440/83

[58] Field of Search ..... 440/38, 40–42, 440/47, 89, 88, 39; 114/270, 55.5; 60/221, 222; 415/175

[56] References Cited

U.S. PATENT DOCUMENTS

| | | | |
|---|---|---|---|
| 3,249,083 | 5/1966 | Irgens | 440/47 |
| 4,474,561 | 10/1984 | Haglund | 440/38 |
| 4,756,664 | 7/1988 | Cohen et al. | 415/175 |
| 4,925,408 | 5/1990 | Webb et al. | 440/38 |
| 5,045,002 | 9/1991 | Torneman et al. | 440/83 |
| 5,720,635 | 2/1998 | Roos | 440/38 |

FOREIGN PATENT DOCUMENTS

| | | | |
|---|---|---|---|
| 262290 | 10/1989 | Japan | 440/47 |

*Primary Examiner*—Ed Swinehart
*Attorney, Agent, or Firm*—Weintraub & Brady, P.C.

[57] ABSTRACT

This invention relates to a marine jet drive having improved operation, especially in regard to having efficient adaptation to propulsion engine and hull design; having a drive shaft with flexible coupling at each end, internal to the jet drive; having through-the-nozzle engine exhaust; having simplified, combined means of steering and reversing; having controllable nozzle aperture and trim control; having combination reverse flow deflector and trim plane; having means to disengage the engine from the jet to obtain true neutral; having protection from and removal of debris in the water intake duct; generally having fewer overhauls, easier serviceability and lighter weight.

6 Claims, 5 Drawing Sheets

MARINE JET DRIVE

This application is a division of Ser. No. 08/456,188 filed May 31, 1995 now U.S. Pat. No. 5,720,635, which is a division of Ser. No. 07/699,336 filed May 13, 1991 now U.S. Pat. No. 5,421,753.

FIELD OF THE INVENTION

This invention relates to an engine driven marine vehicle water jet propulsion apparatus, whereby said apparatus has a plurality of improvements, relating to safety, efficiency, material of construction, adaptability to varied applications, longevity, serviceability, weight and operator comfort.

BACKGROUND OF THE INVENTION

Marine Jet drives propelling a vessel based on water jet propulsion have long been known and used due to certain advantages over the traditional external ship's propeller. An engine driven impeller, rotating inside an impeller housing pumps water from below the vessel through an intake duct, then pressurizes and expels said water through a diffusor housing and a nozzle horizontally behind the vessel. A typical example of such a conventional marine jet drive is seen in U.S. Pat. No. 3,935,833, which shows a pump, that may be driven vertically or horizontally and is positioned near the bottom and transom of a marine vessel. The conventional jet propulsion systems have certain general advantages that make them especially attractive under circumstances where a conventional ship's propeller would be exposed to damage by contact with underwater objects. A jet drive has the further advantage that it does not produce appendage drag and is safe for swimmers and animals who could be hurt by the rotating blades of an external propeller.

The known jet drives have, however, certain drawbacks compared with the conventional external propeller propulsion system. A major drawback is caused by the lack of adaptability to specific engines and hull designs, because of the high expense of manufacturing a specific jet drive for each of a variety of applications.

Furthermore, the conventional jet drives rely in their design concepts on the predictability of the tensile, compression and shear strengths as well as the modulus of elasticity and coefficient of expansion, characteristic of certain metals, to maintain impeller alignment and clearance tolerances in relation to impeller housing, diffusor housing and intake duct. Because of the long unsupported span of the drive shaft in the intake duct, impeller tip clearance needs to be loose to allow for the flexing of said shaft and the relative movement of the forward bearing due to deformation under load of the conventional jet drive intake duct. This loose tip clearance detracts from jet drive efficiency. Operation in sandy water, using conventional jet drives is compounded by water lubricated impeller shaft bearing wear, that in turn causes impeller tip wear because of contact with the impeller housing, further loosening the tip clearance with a further detrimental effect on efficiency. The use of metals, as referenced above, in water produces corrosion and electrolysis, and its deleterious effects on efficiency and longevity of conventional jet drives have to be accepted.

The location of the engine in the vessel is compromised by the need for a flexible drive shaft in front of the conventional jet drive, requiring the placement of the engine further forward in the vessel, taking up more otherwise usable space. A further drawback is the difficulty in sealing a low pressure lubricating oil space from high pressure water generated by the impeller. Another drawback of conventional jet drives is caused by the inability of discharging the engine exhaust gas with the jet stream, leaving a significant heat, odor and noise signature, adversely affecting personnel on and near the vessel. Still another drawback is the large size and weight of the steering and reversing deflectors, used in conventional jet drives, as well as a lack of ability to steer the vessel in case of loss of engine power. Other drawbacks are that finding a neutral position by balancing forward and reverse thrusts, still causes slight vessel movement when no movement is wanted, requiring the presence of personnel at the steering station, to keep the vessel from changing position. Also, the fixed nozzle aperture and lack of trim control of a conventional jet drive allow for only one most efficient operating condition on marine vessels, that are characterized by a variety of loading and trim conditions.

Transom interference with forward water flow during reverse operation hinders the otherwise good reverse and maneuvering capability of a conventional marine jet drive; likewise, trim planes are incompatible in conjunction with conventional jet drive reversing systems because said planes block said forward water flow. Another drawback is the placement of steering and reversing hydraulic control cylinders, hydraulic hoses, position feedback cables, and lubricating hoses outside the vessel, exposed to water and the weather where corrosion and marine growth damage exposed rod ends, hydraulic seals and hoses.

Further, because of the recited deficiencies, conventional jet drives require time consuming disassembly and frequent servicing and repair.

There further is a tendency of waterborne debris to be caught in the water intake duct grid and the impeller or wrapped around the drive shaft of a conventional jet drive, with no quick means of removing it, immobilizing and endangering the vessel as the engine has to be tuned off to clear debris. Clearing the intake duct is a time consuming process, done through the access hatch from inside the vessel or by a diver from below the vessel. Some conventional jet drives have grid cleaning devices built in, however these devices are not effective, and give a false sense of security, and, they do not free the shaft or the impeller from debris.

It is accordingly a primary object of the present invention to provide a marine jet drive propulsion system that overcomes the disadvantages of the known jet drives. In particular, the jet drive according to the present invention provides better efficiency by having better matching capability to engine and hull design without high cost, by means of an exchangeable insert in the impeller housing, with matching impeller, altering the pump characteristics to best advantage of a particular application without changing the impeller housing. Similarly, the nozzle aperture can be changed without changing the nozzle housing by the use of fixed or controllable inserts.

Furthermore, the impeller is rigidly but rotatively supported inside the impeller housing, without the need of a stiff shaft and a bearing forward of the intake duct to maintain impeller alignment. Instead, an internal flexible drive shaft in the intake duct, connects the impeller with the engine, obviating an external flexible drive shaft. Thus, tighter impeller clearance, and better efficiency can be obtained. Any deformation of the intake duct under load, altering the position of the impeller housing and the diffusor housing and impeller shaft alignment in relation to the engine, will be absorbed by the flexible drive shaft. The engine may be placed on resilient mounts, as the output shaft movement in relation to the impeller shaft, likewise will be absorbed by the flexible drive shaft. The design concept using a flexible drive shaft eliminates the detrimental effect of a lower tensile, compression and shear strength, and the less predictable modulus of elasticity and coefficient of expansion of composite materials. The use of non-metallic, non-conductive materials avoids corrosion and electrolysis. The internal flexible drive line allows the engine to be placed further rearward to gain usable space in the vessel. The intake duct is provided with a shaft sleeve enclosing the flexible drive shaft, keeping water from coming into contact with said shaft. Material of construction of said drive shaft may be chosen entirely based on strength, without concern of corrosion and may be smaller in diameter and lighter in weight. The use of low cost, easily serviceable water and oil shaft seal arrangements is possible because of the tight tolerance of the impeller shaft bearings. A void space is provided between oil seal and water seal, connected via a port internal to diffusor housing and impeller housing to the vessel's interior, where a sensor may determine the presence of lubricant or water, alerting the operator to a seal failure. Similarly, lubricant feed and drain ports connect the bearing space inside the diffusor housing internally, then internal to the impeller housing to a reservoir inside the vessel. Said void space drain port and lubricant ports are produced as an integral part of the diffusor housing and impeller housing and avoid the need for external hoses exposed to the elements.

Furthermore, an engine exhaust internal to the jet nozzle is provided, to improve engine efficiency, because of suction created by the jet stream and improve personnel comfort by ejecting exhaust heat, noise and fumes with the jet stream. U.S. Pat. No. 3,943,876 shows engine exhaust in combination with the jet stream, however the exhaust is peripheral to the jet stream and is added behind the jet nozzle and is not internal to it and does not enhance efficiency or remove exhaust heat and fumes with the jet stream, nor does it suppress exhaust noise. U.S. Pat. No. 4,552,537 uses exhaust gases and engine generated heat to decrease behind-the-jet nozzle frictional losses between a submerged jet stream and surrounding water to render said jet stream more effective.

Further, the invention provides a combined steering and reversing mechanism that is lighter in weight and smaller in dimension and has improved performance. U.S. Pat. No. 4,538,997 displays a reversing means, whereby a single, centrally located reversing scoop moves up from the bottom of a steering tube, deflecting water for reversing down and forward. The present invention uses a single fixed split duct with right and left ports or twin reverse ducts, fastened to left and right steering deflectors, sending water flow forward and angled away from the intake duct during reverse operation and is in concept different from the referenced patent.

A discharge nozzle aperture control means is provided to allow most efficient performance at varying vessel conditions. U.S. Pat. No. 4,176,616 shows an externally applied two position thrust controller. The present invention in contrast does not control thrust, but refers to an internally attached permanent or adjustable nozzle aperture and directional trim control, that has as purpose the adaptation of the aperture of the nozzle to obtain most efficient operation under varying vessel conditions such as longitudinal center of gravity and vessel weight.

A set of steering vanes may be provided, attached to the outer surfaces of the reverse ducts, as they are fastened to the steering/reverse deflectors and move with said deflectors. U.S. Pat. No. 3,982,494 provides for an auxiliary rudder that is actuated by the jet pump pressure and swings out of the way at higher speeds, to reduce drag. The present invention uses the reverse ducts, also a subject of the present invention, to rigidly support the steering vanes.

Also provided is reverse operation eliminating backwash against the transom using a reverse/trim plane in close proximity to the jet drive, that retracts to a position above the reverse ducts during reverse operation forcing all forward water flow underneath the vessel. In forward direction the reverse/trim plane may be adjusted like a trim plane.

The mechanical or hydraulic controls, operating the combined steering/reversing deflectors, the nozzle aperture inserts and reverse/trim plane are placed inside the vessel to avoid marine growth and weather exposure. They are however attached to the impeller housing forward flange. Sliding control rods with water seals at the transom connect said deflectors, aperture inserts and reverse/trim plane to the mechanisms inside. This allows the installation and adjustment of said mechanisms to be done at the factory, without the need of having the intake duct present. Additionally, these control mechanisms have a park position whereby all control rods are pulled into their retracted positions, preventing damage from corrosion and marine growth to the sealing surfaces, while the vessel is idle for extended periods of time. Even in the event of failure of said water seals, only water will leak into the vessel and no oil will leak into the water, avoiding pollution and hydraulic system failure.

Further, there is provided an automatic zero movement neutral position by means of a centrifugal clutch that disengages at idle speed. An interlock is provided to prevent the clutch from engaging in the park position, to allow high idle speeds and starting of the engine without activating the jet drive.

Furthermore, a more efficient intake duct is provided by means of a gradually rising rearward edge of the bottom intake opening, forming a wedge shaped section back down to said intake opening. said rising rearward edge produces a diminishing apparent intake opening as the vessel moves faster in forward direction, while the wedge lower surface produces added lift to the vessel. U.S. Pat. No. 3,993,015 shows an elevated intake opening rearward edge parallel to the intake opening level, to permit a simpler manufacturing procedure and does not compare in relation to its position or its function. The invention further provides better protection of the intake duct against floating debris, by means of tapered grid bars as well as an intake debris removal system using pressurized fluid ejection from the grid bars, in a continuous manner or in a short burst. A debris cutting device is placed just forward of the impeller to prevent debris from wrapping around the impeller hub.

Further, construction, operation, weight reduction and maintenance features are part of the invention, as will be described in detail in the following presentation with appended drawings and claims.

SUMMARY OF THE INVENTION

Bearing in mind the foregoing, it is a principal object of the present invention to improve the adaptability of a marine jet propulsion means to varying vessel shapes, engine power and speed requirements by modifying the pump characteristics and the jet nozzle aperture and jet direction without the requirement of replacing the impeller housing and the nozzle housing. The use of a wear ring insert in the impeller housing with matching impeller modifies the pump; one or more inserts in the nozzle housing modify the aperture in permanent or controllable manner.

A collateral object is the rigid but rotative suspension of the impeller shaft in the diffusor housing; the mounting of an impeller to said shaft may be by means of a quick release taper arrangement; the bearings supporting said shaft being located internal to said diffusor housing, transmitting bearing forces and impeller thrust in a concentric and symmetrical manner along the centerline of said shaft to the impeller housing and the intake flange on the vessel, said arrangement permitting a close tolerance between impeller tip and wear ring inside impeller housing.

A subsequent collateral object is the provision of lubricant for said bearings, said lubricant being supplied and drained via ports internal to diffusor housing and impeller housing and connected to a reservoir with level alarm inside the vessel. Said ports are internal to diffusor and impeller housing to prevent exposure of external hoses to the elements.

A subsequent collateral object is the use of a drive shaft with a flexible, universal or constant velocity coupling with a spline connection at each end, attached to the impeller shaft at one end and the engine output shaft at the other end, absorbing alignment errors as the result of intake duct deformation and engine movement on resilient motor mounts.

A subsequent collateral object is the placement of a shaft sleeve over said drive shaft, said sleeve being rigidly fastened to the intake duct, serving to protect the drive shaft from coming in contact with water in the intake duct, preventing debris from wrapping around said shaft and allowing the selection of a stronger shaft material without regard to corrosion prevention, so reducing shaft size and weight; providing a mounting point for the forward shaft seal cartridge, that is placed between the impeller and the shaft tube; and provide a back stop for the fixed blade of the rotating debris cutter, said cutter being attached to the impeller hub; said seal cartridge allowing for mis-alignment between impeller shaft and shaft sleeve as a result of intake duct deformation and also providing a quick disconnect feature when impeller and shaft sleeve are separated, said seal being in cartridge form, to prevent damage to the seal faces during installation and removal.

Another collateral object is to separate water, pressurized by the impeller from said lubricant by the creation of a void space with a lubricant seal on one side and a rear water seal on the other side, said void space being connected via a port internal to the diffusor housing and the impeller housing to the vessel's interior, where it is connected to a suitable reservoir with detecting means for lubricant or water, alerting vessel operator of an oil seal or a rear seal failure; said port being internal to diffusor housing and impeller housing to avoid exposure of an external hose to the elements; a labyrinth seal being placed between diffusor inner housing forward edge and the impeller bell rearward edge to reduce the pressure on said rear water seal and decrease the thrust load on said bearings.

A further collateral object is bringing the engine exhaust into the jet stream internal to the nozzle, to eject said exhaust with said jet stream under vacuum, created by the jet velocity, so improving said engine's performance, ejecting exhaust heat and fumes and suppressing exhaust noise; during reverse operation the exhaust port is closed and a valve arrangement opens above atmospheric pressure to allow escape of exhaust gases on either side of the jet drive; alternately, air or a mixture of exhaust gas and air nay be admitted into the nozzle for water aeration purposes.

A further collateral object is obtaining a lower bulk and lover weight steering and reversing system with left and right steering/reversing deflectors, attached to the jet nozzle so that they can rotate in the horizontal plane; the shape of said steering deflectors chosen in a manner, that engagement of either deflector with the jet stream causes a deflection of said jet stream and a resulting steering response in the opposite direction; when both deflectors are closed cutting off the rearward flow of the jet stream, a baffle arrangement forces the jet stream down into reverse ducts splitting the stream into a right and left duct and directing it forward and underneath the vessel, to effect a reverse reaction. Moving the deflectors in unison, while closed, will deflect more water to the left or right reverse duct, so obtaining steering in reverse. A neutral position may be found by closing the steering/reverse deflectors part way until the forward and reverse forces balance. Steering vanes way be attached to said deflectors, to obtain steering when engine is not running.

Another collateral object is reverse operation, eliminating backwash against the transom using a reverse/trim plane in close proximity to the jet drive retracting above the reverse duct discharge ports during reverse operation forcing all forward water flow underneath the vessel. In forward direction it is adjusted and functions like a trim plane.

A further collateral object is the mechanical or hydraulic control of the combined steering and reversing deflectors the nozzle aperture inserts and reverse/trim plane from inside the vessel to avoid marine growth and weather exposure to the control mechanisms; said control mechanisms however being attached to the impeller housing forward flange, allowing the installation and adjustment of said mechanisms to be done at the factory, without the need of having the intake duct present. Sliding control rods with water seals at the transom connect said deflectors aperture inserts and reverse/trim plane to the mechanisms inside. Additionally, these control mechanisms have a park position whereby all control rods are pulled into their retracted positions, to prevent corrosion and growth on the sealing surfaces of said control rods during idle periods.

Further, a collateral object is an automatic zero movement neutral position by means of a centrifugal clutch disengaging the jet drive shaft from the engine at idle speed; an interlock being provided to prevent the clutch from engaging in the park position.

Furthermore, another collateral object is a more efficient intake duct, provided by means of a gradually rising rearward edge of the bottom intake opening, of the intake duct, forming a wedge shaped section back down to said intake opening. Said rising rearward edge produces a diminishing apparent intake opening as the vessel moves faster in forward direction, while the wedge lower surface produces added lift to the vessel.

Another collateral object is better protection of the intake duct against plugging by floating debris, by means of rearward tapered grid bars, providing increased clearance toward the rear edge; an intake debris removal system using pressurized fluid ejection from said grid bars, in a continuous manner or in a short burst. A debris cutting device is placed just forward of the impeller to prevent debris that passed the grid bars from wrapping around the impeller hub.

A further collateral object is the quick servicing capability, of the part of the jet drive assembly disposed generally behind the intake flange, including impeller housing, diffusor housing, nozzle housing, inner housing and impeller, with all attachments thereto. Upon release of the impeller housing flange from the intake flange, and release of the void space drain and oil lines, the movement in rearward direction of said assembly causes the snap action locking feature of the water seal cartridge at the shaft sleeve/impeller hub interface to disengage and the forward spline connection of the drive shaft to disengage, so that said portion of the jet drive can be removed. Wear ring insert, Impeller, debris cutter and all seals can now be serviced without the need of further jet drive disassembly or drainage of the lubricant cavity. Reversely, the re-installation of the jet drive assembly can be accomplished quickly. The removal and re-installation may be done under water, by providing special covers for the impeller housing flange oil and void space connection fittings as well as a shaft sleeve cover, preventing water from entering the vessel, when the assembly is removed.

A further collateral object is the reduction of parts and weight. The impeller housing, the diffusor housing and the nozzle housing are all equipped with features according to this invention, that allow major changes in jet drive performance, without said housings changing shape. Accordingly said impeller, diffusor and nozzle housings may be made as one piece, eliminating two flange connections and associated fasteners, also making the one piece lighter than the combination of the three.

Further objects and advantages of this invention will be apparent from the following detailed description of a presently preferred embodiment which is illustrated schematically in the accompanying drawings.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION OF THE PREFERRED EMBODIMENTS

Figure 1:
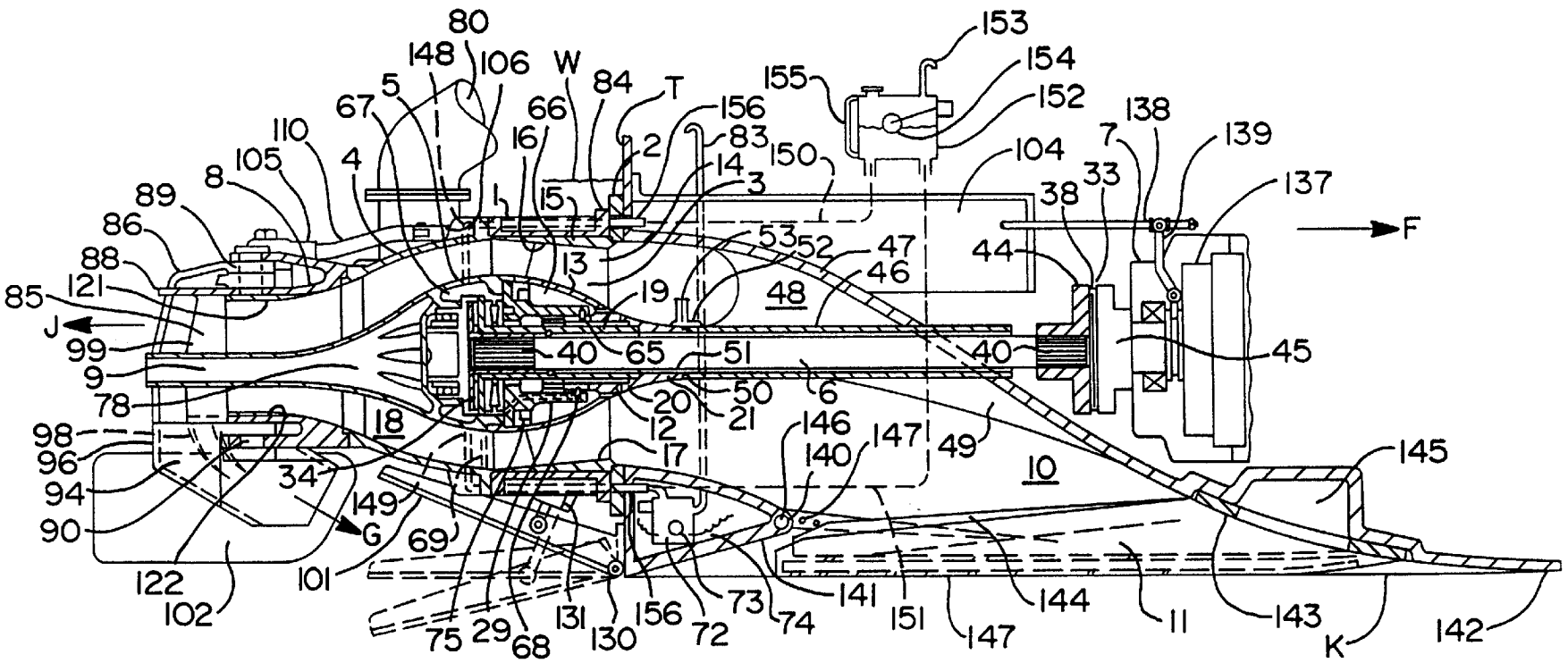
FIG. 1 is a cross sectional view over the shaft centerline, to show the interior construction.
Figure 2:
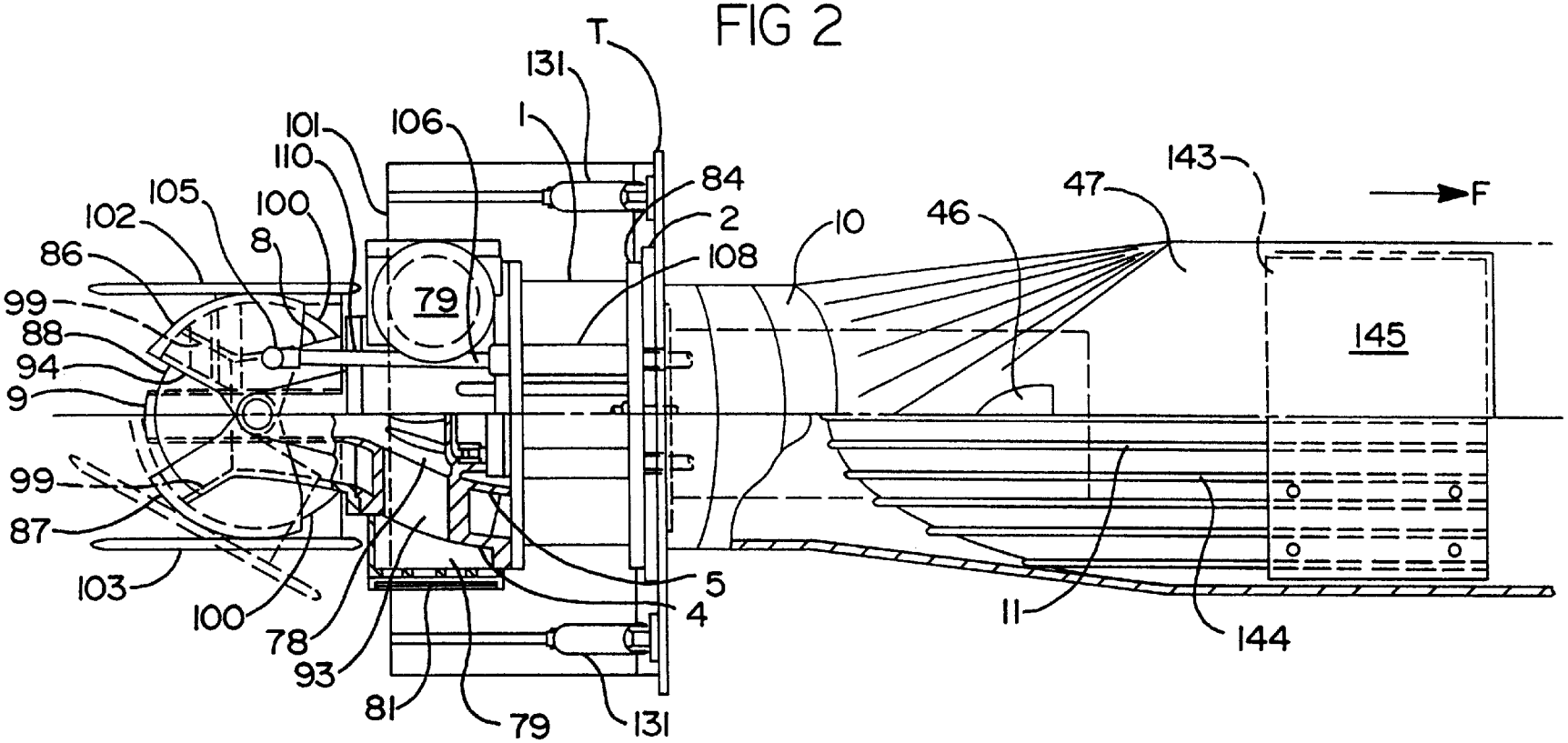
FIG. 2 Is a partially broken plan view of the invention to show the bottom opening of the intake duct and the cross section of a stator vane and the right exhaust plenum.

In accordance with the invention there is provided a marine jet drive as shown in FIGS. 1 and 2, located generally at the transom T of a vessel and generally above the line line K, with the direction of the jet stream J rearward, to promote said vessel's movement forward as indicated by arrow F. Said jet drive has an impeller housing 1, attached to intake flange 2; a rotatable impeller 3, disposed in impeller housing 1, its axis of rotation aligned generally with keel line K; a diffusor housing 4 connected to the impeller housing 1 forming a water outlet port; an inner housing 5, disposed inside diffusor housing 4; a drive shaft 6, rotatively connecting the impeller 3 with the engine 7; a nozzle housing 8 forming a rearward facing nozzle, attached to the diffusor housing 5, having means of deflecting jet stream J; an engine exhaust discharge tube 9, attached to inner housing 6; a water intake duct 10, placed ahead of the impeller housing, attached to the vessel and transmitting the generated thrust forces to said vessel; and an intake grid 11, disposed in the intake duct 10.

Impeller 3 includes an impeller hub 12, an impeller bell 13 and a plurality of impeller blades 14 having blade tips 16 radially extending from the impeller bell 13. A circular wear ring insert 15 is inserted coaxially, snugly fitting the inside of the impeller housing 1, the impeller blade tips 16 extending to within close proximity of the inner surface 17 of the wear ring insert 15. The blades 14 are advantageously positioned to promote fluid flow from the intake duct 10 to the diffusor housing 4 when the impeller 3 rotates. The diameter of inner surface 17 of wear ring insert 15 may vary and the shape of the inner surface 17 of wear ring insert 15 may be cylindrical, conical or bell shaped, depending on the performance requirements of the jet drive application. The size and shape of impeller housing 1 and diffusor housing 4 are not affected by the variation of inner surface 17. The pump characteristics can be greatly varied without the requirement of a different impeller casting to produce impeller 3, or a different diffusor housing or impeller housing.

The diffusor housing 4 supports the inner housing 5 by a plurality of stator vanes 18, radially disposed between diffusor housing 4 and inner housing 5, as seen in FIGS. 1 and 2. The stator vanes 18 are advantageously positioned to recover the rotational energy, imparted by the impeller 3. At least one of these vanes 18 may have an internal port 93 or a port 69, 148 or 149, for the fluid communication of air, exhaust gases, lubricating oil and/or drain water to and from the inner housing 5 to and from the periphery of the diffusor housing 4.

Figure 4:
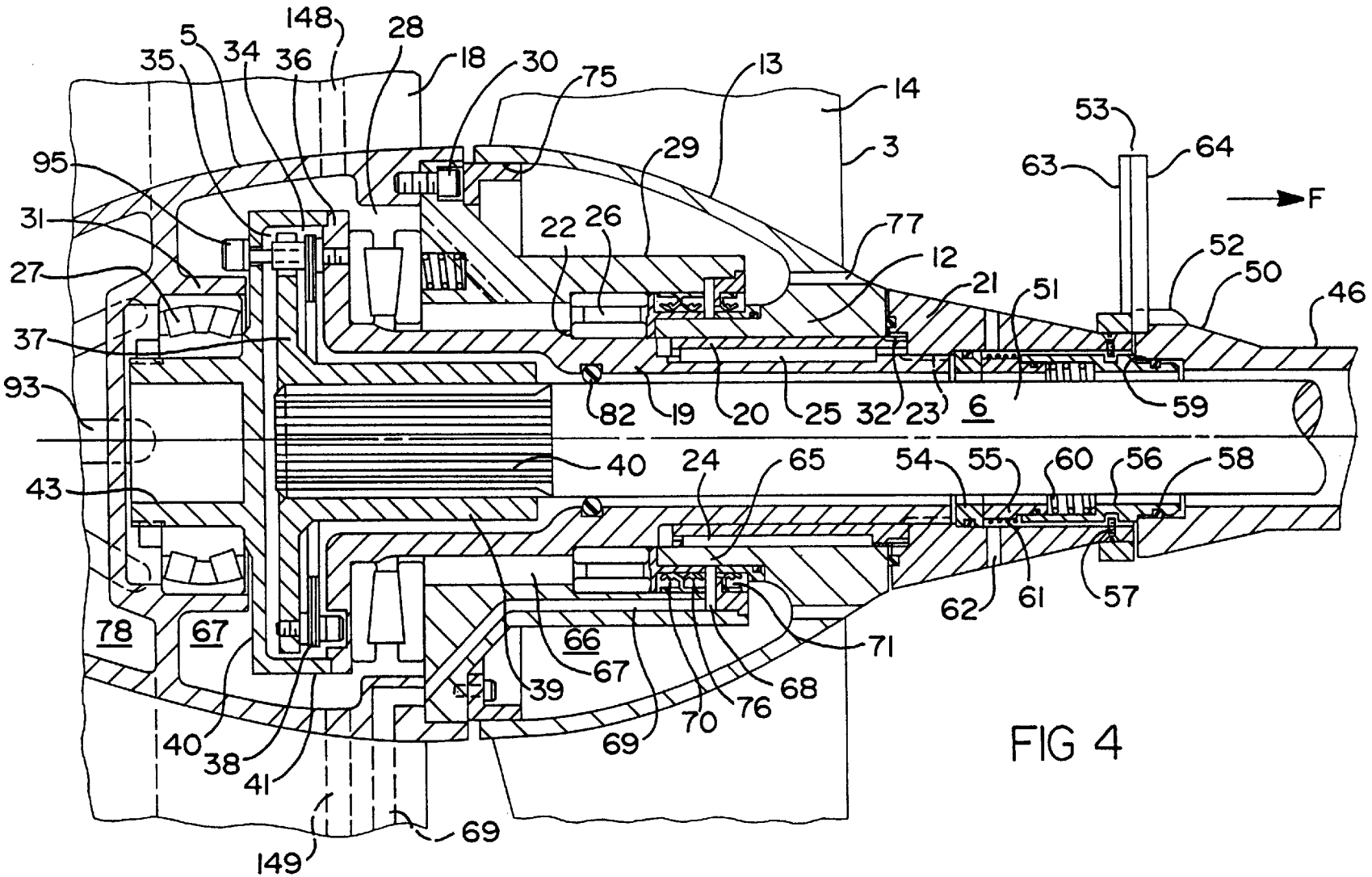
FIG. 4 is an enlarged elevational cross-section through the centerline, showing details of the impeller hub tapered bushing arrangement, shaft tube suspension, drive shaft and flexible coupling arrangements and the seal arrangements.

In accordance with a further feature, there is provided a jet drive, where the impeller 3 is supported on a shaft tube 19, as shown in FIG. 4. The impeller hub 12 is tapered towards the rear and accepts coaxially a split tapered bushing 20, that in turn fits coaxially over shaft tube 19 and may be pushed tightly into the impeller hub 12 by means of impeller lock nut 21, engaged by thread 23 to the shaft tube 19, to lock said hub in place on said shaft tube. An abutment 22 on the shaft tube 19 prevents the impeller hub 12 from moving rearward as the lock nut 21 is tightened. A thread 32 on the tapered bushing 20, permits the application of releasing force by means of a release nut (not shown), against impeller hub 12 to release the tapered bushing 20 and free the impeller hub 12 from the shaft tube 19, so providing a quick installation and release method for installing and removing the impeller 3. The impeller torque is transmitted via 2 or more keys, at least one outer key 24 between impeller hub 12 and tapered bushing 20 and at least one inner key 25 between bushing 20 and shaft tube 19. The tapered bushing 20 is oriented to cause the thrust in forward direction F, generated by the rotation of the impeller 3, to force said impeller tighter on said tapered bushing.

In accordance with a further feature there is provided a jet drive with a rotatively supported shaft tube 19 to support the impeller, as shown in FIG. 4. Said shaft tube is suspended by a forward journal bearing 26, a rear journal bearing 27 and a thrust bearing 28. The rear journal bearing 27 and the thrust bearing 28 provide axial lock-up of the shaft tube. The thrust force of the impeller 3 is transmitted via tapered bushing 20 to the shaft tube 19 by the thrust bearing 28 to a bearing support 29, that also supports the forward journal bearing 26. Said bearing support is affixed to the inner housing 5 with a plurality of fasteners 30 at the interface between inner housing 5 and bearing support 29. The rear journal bearing 27 is supported directly by a recess 31 in the inner housing. This support method fixes the impeller 3 rigidly but rotatively in relation to the impeller housing 1, and allows for closer tolerances between impeller tips 16 and wear ring insert inner surface 17, so improving the efficiency of the jet drive.

In accordance with still another feature, there is provided a marine jet drive which includes a drive shaft 6 with a forward flexible coupling 33, inside the vessel, coupling engine 7 to said drive shaft and a rear flexible coupling 34 inside a cavity 35 in the shaft tube 19, coupling drive shaft 6 to the shaft tube 19. The shaft tube 19 is split perpendicularly to the axis of rotation at the largest diameter of cavity 35, to facilitate the installation of the rear flexible coupling 34. The forward wall of the cavity 35 is formed by a flange 36, rigidly attached to the shaft tube 19. Said flange transmits the thrust load to the thrust bearing 28 and serves as the driven part of flexible coupling 34. The driving flange 37 of said coupling is suspended in cavity 35 via the flexible element 38 of coupling 34 and has a hub 39, that is provided with a spline connection 40 engaging shaft 6. A flexible seal 82 may be placed between shaft tube 19 and drive shaft 6 to prevent water entry into the rear flexible coupling cavity, while said drive shaft may articulate as permitted by the coupling 34. The coupling cavity 35 is further formed by a rear flange 41 with a forward protruding rim 42, engaging the forward flange 36 of the cavity 35 with a close tolerance register, to maintain alignment of the rear journal bearing 27 with the forward journal bearing 26 and thrust bearing 28. At the other side of rear flange 41 is located a hub 43 supporting rear journal bearing 27. At the forward end of the drive shaft 6 is a similar flexible coupling 33, with the driven flange 44 attached to the drive shaft 6 with a spline connection 40 similar to the one in hub 39. The driving flange 45 is attached to the output shaft of engine 7, which may be placed an resilient engine supports (not shown), to limit transmission of engine vibrations to the vessel. Engine movement and misalignment are absorbed by the flexible couplings 33 and 34 and spline connections 40 and no external flexible drive line is needed to accommodate said engine movement and mis-alignment, while allowing placement of the engine 7 directly adjacent to the jet drive. The spline connection 40 provides torque transmission and permits axial movement between drive shaft 6, flanges 37 and 44, while allowing quick release of said drive shaft from said coupling flanges, by extraction of the drive shaft 6 from either or both flanges.

Alternately, when the engine 7 is placed further forward in the vessel, a drive shaft forward bearing (not shown) may be placed in stead of engine 7 and a line shaft may be coupled to the drive shaft 6.

The marine jet drive may further include a shaft sleeve 46 in the intake duct 10, enclosing the drive shaft 6, supported by intake upper wall 47 and upper and lower longitudinal webs 48 and 49 in said intake duct. The sleeve 46 prevents the exposure of the rotating drive shaft 6 to water and debris, that might be ingested by the intake 10 and get wrapped around said drive shaft, inducing cavitation of the impeller 3, by producing turbulence in the water inflow. Additionally, as no water from intake duct 10 comes in contact with drive shaft 6, by virtue of forward seal cartridge 51 and shaft sleeve 46, the alloy of manufacture of said drive shaft may be chosen purely for its strength and not for corrosion protection, the higher strength permitting a smaller and lighter drive shaft 6. At the shaft sleeve rear end 50 is provided a mounting means for a forward seal cartridge 51 between the impeller locking nut 21 and the shaft sleeve 46. Further, the inner bore of the sleeve 46 may be tapered, providing a larger bore diameter towards the forward end of the drive shaft, to allow for the increased drive shaft articulation as the forward flexible coupling 33 is approached, as shown in FIG. 1.

The instant invention further provides for a forward seal cartridge 51, to protect the sealing surfaces between seal face 54 and seal element 55 and allow quick engagement and withdrawal without the need for access, as shown in FIG. 4. It prevents water in the intake duct 10 from entering between the forward end of the rotating impeller hub 12, where impeller lock nut 21 is located and the rear end 50 of the fixed shaft sleeve 46. Since shaft sleeve 46 is in fluid communication with the vessel's interior, it prevents water from entering the vessel. Seal cartridge 51 may be fastened to, or be an integral part of the impeller lock nut 21, while it engages the opposing sleeve end 50, with a snap action locking and sealing feature. The forward seal cartridge 51 consists of a rotary seal face 54, held in place by suitable means, a static seal element 55 and a spring housing 56, which is held captive by retaining pins 57, holding the seal assembly inside impeller lock nut 21 and so forming a cartridge, preventing the separation of the sealing surfaces. Engaging the forwardly protruding end of spring housing 56 in at recess in sleeve end 50 will force O-ring 58 to compress and then expand again as the neck of the recess is overcome, pulling the spring housing 56 forward, until abutment 59 seats on the end face of shaft sleeve end 50. When so engaged, the spring housing 56 will be moved rearward, in relation to retaining pins 57, so that they no longer touch spring housing 56 and can rotate freely with impeller lock nut 21. The spring 60 forces seal element 55 against seal face 54. The heat generated by the friction between said seal face and said seal element, will be conducted through the seal element to cooling fins 61 at its outer surface. Water from the intake duct is pulled in from the gap between impeller nut 21 and sleeve end 50, then is pulled past said cooling fins and exits through a plurality of radially disposed holes 62 in lock nut 21, by centrifugal force. Rotational lock-up is provided between seal element 55, spring housing 56 and sleeve end 50, to prevent said components from turning with the seal face 54.

Figure 7:
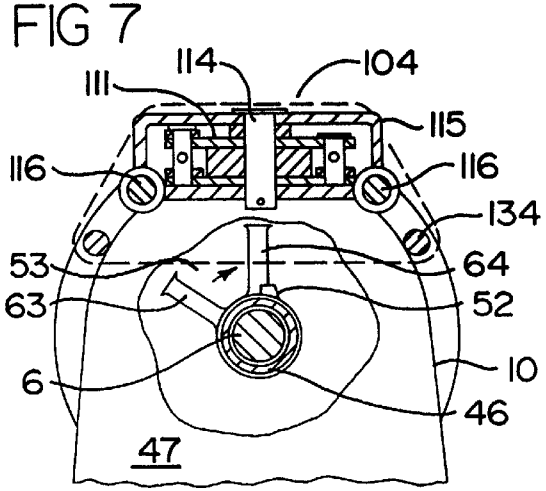
FIG. 7 is a fragmentary, partially broken elevational view looking rearward, showing the steering and reversing mechanism as well as the debris cutter.

A further function of the shaft sleeve 46 is providing a fixed support for a debris cutting device 53, mounted on the impeller lock nut 21, as shown in FIGS. 4 and 7. Its purpose is to cut long stranded debris, that has passed through intake grid 11 and prevent it from wrapping itself around impeller hub 12 and against impeller blades 14, thereby causing the pump to cavitate and/or become unbalanced. The cutting device 53 consists of one or more rotating blades 63 and one or more stationary blades 64, the latter kept from rotating by back stop 52 on sleeve end 50.

A rear sealing arrangement 65 according to this invention is placed between the forward journal bearing 26 and the cavity 66 surrounded by the impeller bell 13 and the bearing support 29, which is filled with pressurized water during jet drive operation, as shown in FIGS. 1 and 4. The cavity 67, enclosed by the inner housing 5 and the bearing support 29 contains all bearings and is filled with lubricating oil at atmospheric pressure. To separate said oil and water and diligently prevent their mixing, a void space 68 is created between the forward bearing and the cavity 66, that is connected via a void space drain port 69 through stator vane 18 and through impeller housing 1 and transom flange 2, to the vessel's interior. An oil seal 70 is placed adjacent to the forward bearing 26, to close off the oil cavity 67 and a water seal 71 is placed between the bearing housing 29 and the impeller hub 12, to close off the water cavity 66. Failure of either seal will cause fluid drain into the void space 68 and to the vessel interior via drain 69, where water or oil may be observed, to identify a seal failure. A suitable reservoir 72 may receive said water or oil and by means of a float switch 73 and electrodes 74 remotely alert the vessel's operator whether the fluid is the result of a water or oil seal failure. To further protect against a water seal failure, first a labyrinth seal 75 is placed at the periphery of the impeller bell 13, to reduce the pressure in the space enclosed by said bell and the bearing support 29, as shown in FIG. 1. The relief ports 77 through the impeller bell 13 bring the water pressure in cavity 66 down to that of the intake duct and consequently reduce the thrust load on the thrust bearing 28 and the pressure on the water seal 71. Secondly, as shown in FIG. 4, an emergency seal 76 is placed adjacent to the oil seal 70 on the void space side, so that even in the event of failure of both water seal 71 and labyrinth seal 75, water will be prevented from entering the oil and a steady water flow from the void space drain 69 will identify that condition. Consequently, to prevent flooding of the vessel as a result of said water flow, the reservoir 72 is provided with a suitable vent and drain duct 83, that rises well above vessel waterline W, and drains over board.

Figure 3:
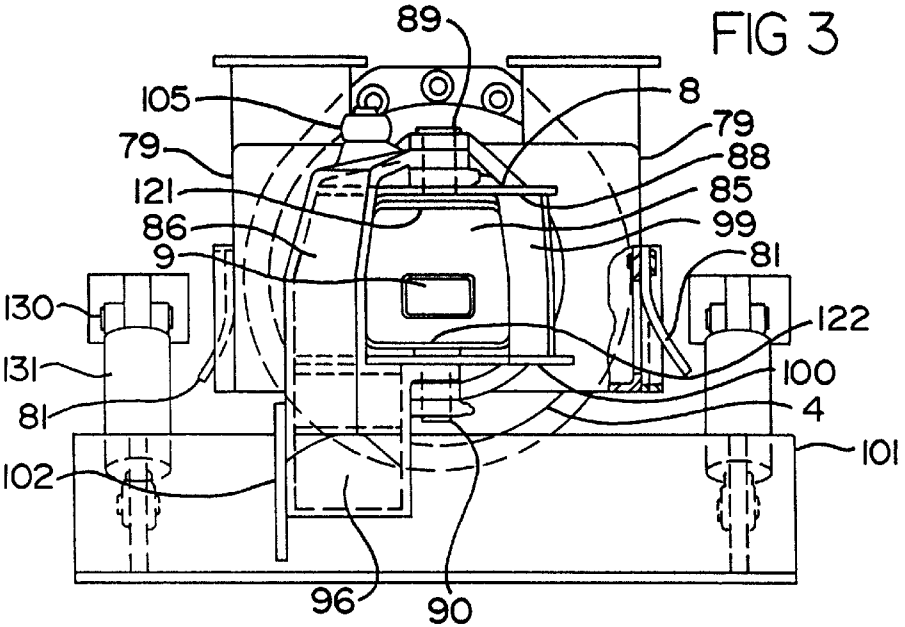
FIG. 3 is an end elevation view of the invention looking forward, showing the left steering/reversing deflector (the right deflector is omitted to show the nozzle and baffles) and reverse/trim plane arrangement.

The present embodiment of the invention further includes an engine exhaust tube 9, placed inside the nozzle housing 8 in the jet stream, producing suction for the discharge of engine exhaust gases and noise from the engine 7 inside the vessel, as shown in FIGS. 1, 2 and 3. The exhaust tube 9 is supported by the inner housing 5 and is in fluid communication with an inner plenum 78, formed by the tail end of the inner housing 5. One or more outer plenums 79 are located on the periphery of diffusor housing 4 and are in fluid communication with the inner plenum 78 via ports 93 in one or more stator vanes 18. The exhaust from the engine enters through exhaust ducts 80 into outer plenums 79. When the jet drive is operating in the reverse mode, the exhaust tube 9 is closed off by steering/reversing deflectors 86 and 87, to prevent water from entering the exhaust system. The outer plenums 79 are provided with flapper valves 81 that open when pressure inside said outer plenums exceeds atmospheric pressure, allowing engine exhaust gases to escape when the impeller is not turning or when the jet is operating in reverse. The exhaust suction created by the exhaust tube 9 has a beneficial effect on the performance of the engine 7, improving efficiency and increasing the available power of said engine. Exhaust fumes are ejected with the water jet stream J and exhaust noise is muffled as it is not exposed to the atmosphere in the vicinity of the vessel.

Furthermore, by allowing air instead of exhaust discharge to enter the exhaust tube 9, by exposing the intake of outer plenum 79 to the atmosphere instead of exhaust duct 80, an effective method of aeration of a body of water may be obtained. This is important where the combined purposes of marine propulsion and water aeration are of benefit.

The exhaust tube 9 may be detachable from inner plenum 78 for the purpose of exchanging said exhaust tube, without the need to change the diffusor housing. The varying power output of engine 7 and a varying nozzle port 85 aperture may require said exhaust tube to be of varying size.

The jet drive further includes a nozzle housing 8, at the rearward end forming the nozzle discharge port 85, to accelerate the jet stream and is shaped on the outside to accommodate and support the left and right steering/reversing deflectors 86 and 87. The nozzle discharge port 85 is shaped advantageously, to promote the efficient functioning of said nozzle port, the efficient deflection of the jet stream J for steering while moving forward, and the efficient deflection for reversing and steering while in reverse. This shape may be circular, oval, rectangular or trapezoidal or any combination of these shapes. The present embodiment in cross sectional view, prefers a shape symmetrical about a vertical axis through the center of the impeller axis, of trapezoidal shape for the upper half of the nozzle and of rectangular shape for the bottom half of the nozzle discharge port 85, with the upper and lower corners rounded off in circular shape, as best shown in FIG. 3.

Figure 5:
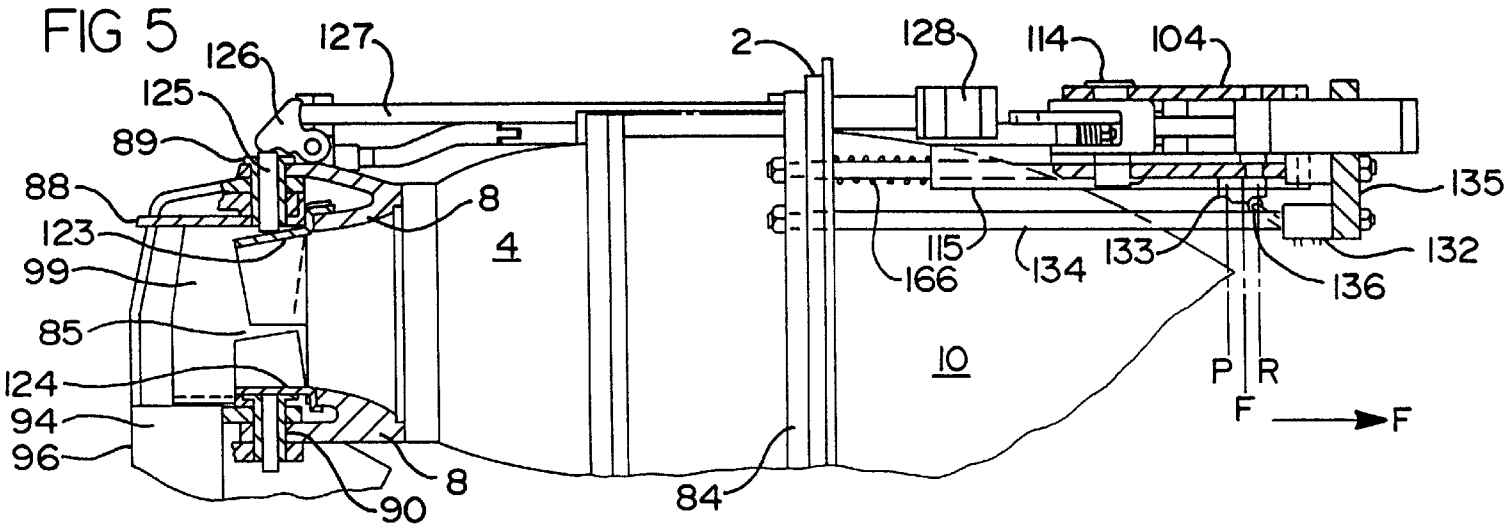
FIG. 5 is a fragmentary partially broken elevational view of the invention to show aperture control and trim control arrangements and the steering mechanism.
Figure 6:
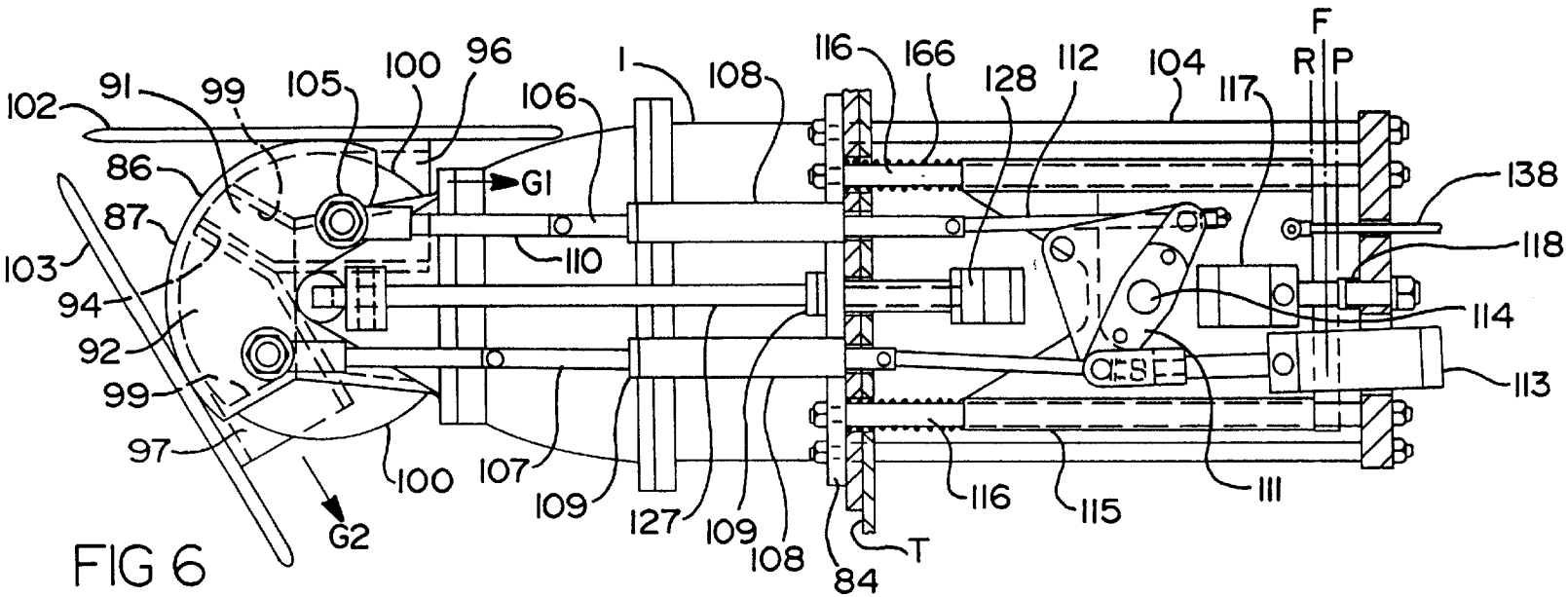
FIG. 6 is a fragmentary, partially broken plan view of the invention showing details of the steering and reversing system.

The steering/reversing deflectors 86 and 87 are each pivotally suspended about vertical axes, that may be parallel and separate or coincident. The present embodiment shows coincident suspension about a common upper pivot pin 89 and common lower pivot pin 90. These deflectors are located to each side of the nozzle and consist of segments, that may be cylindrical spherical or conical in shape or any combination of these. The present embodiment provides for the upper half to be conical and the lower half to be cylindrical. The nozzle shape generally matches this shape. Upon actuation of the left deflector 86 to engage the jet stream J, the reaction will be to turn the vessel to the right, the reaction being stronger as the deflector engages a larger portion of said jet stream. The opposite reaction will result from actuation of the right deflector 87. At the bottom of each deflector and below the jet stream J are disposed reversing ducts 96 and 97, rigidly attached to deflectors 86 and 87, so that they turn with said deflectors. When both deflectors are simultaneously fully engaged in the jet stream J and close off the rearward flow of the water, said jet stream's only escape will be down and forward through the reversing ducts 96 and 97, producing a forward flow G and a reverse reaction on the vessel, The orientation of said reverse ducts is such that the flow direction in straight reverse steering position, from reverse ducts 96 and 97, is approximately 30 degrees away from straight forward to the left and to the right, to avoid depositing aerated water near the jet drive intake duct 10. The direction is also approximately 30 degrees downward, so that the reverse flow may pass below the vessel transom T and below reverse/trim plane 101, when in the retracted position. These angles may vary, to suit specific requirements. The water flow to the reverse ducts 96 and 97 is divided by the inside vertical baffles 94 of the reverse ducts. In the reverse position, said vertical baffles come together and form a single flow divider. Reverse steering is obtained by rotating the steering/reverse deflectors in unison, as shown in FIGS. 5 and 6, where said deflectors and said flow divider are in the reverse, hard to port position. Left duct 96 has a small cross hatched area 91 feeding it, while cross hatched area 92 identifies the much larger area of flow to the right duct 97. This results in a reverse jet stream G2 much stronger than G1, resulting in a reverse left turn. One or more turning vanes 98 may be placed in reversing ducts 96 and 97, to promote efficient reverse flow and increase structural integrity of said reversing ducts. Alternately, in a different embodiment, the reverse duct may be replaced by a single split duct, rigidly attached to nozzle housing 8, placed below the steering/reverse deflectors. Said split duct having left and right outlet ports aimed in forward direction at angles approximately 30 degrees away from straight forward and approximately 30 degrees downward. The vertical baffles 94 remain rigidly attached to the steering/reversing deflectors and as before, when placed together in reverse, form a flow divider. Said vertical baffles extend to close proximity of the split reverse duct, preventing water from escaping into the opposite port. Steering action in reverse, causes flow variation to the right and left outlet and reverse steering action as a result. The advantage of this embodiment is a lower force on the vertical pivots 89 and 90, a lower strain on control rods 106 and 107 and less aeration of the intake duct 10 when steering in reverse, but no steering vanes 102 and 103 can be used.

A neutral position way be found by closing both deflectors 86 and 87 until the composite of reverse jet streams G1 and G2 is in balance with forward jet stream J.

In this embodiment, the conical shape of the upper parts of deflectors 86 and 87, serves to promote the jet flow downward to the reverse duct, without adversely affecting the steering function in forward. In other embodiments, a sideways reverse flow may be produced, or a combination of directions may be produced, depending on the shape of the nozzle discharge port and steering/reverse deflectors chosen.

Baffle 88 is located above nozzle discharge port 85, in the horizontal plane and prevents upward escape of the jet stream J, when the steering/reversing deflectors engage said jet stream. Baffles 99 are placed to each side of the nozzle discharge port 85 with their outer edges in close proximity to the steering deflectors, as shown in FIGS. 1, 2 and 3. Baffles 100 are located at the base of the nozzle in the horizontal plane and serve to form the upper walls of the reversing ducts 96 and 97. Baffle 88 and baffles 99 are joined respectively at their outward and upward edges; baffles 99 and 100 are joined at respectively the lowermost and rearmost edges, forming one continuous baffle arrangement, preventing jet stream escape in any direction but rearward or downward.

A steering and reversing control assembly 104 as shown in FIGS. 5, 6 and 7 is coupled to the deflectors 86 and 87 with rod end bearings 105 for turning said deflectors into the jet stream J and may be hydraulically or mechanically or electromechanically actuated. The control assembly 104 is advantageously placed inside the vessel to protect said assembly from the corrosive action of water and air outside the transom T. Said assembly is suspended directly from the forward flange 84 of impeller housing 1. This permits the installation and alignment of the assembly 104 in the factory, without the presence of any components forward of transom flange 2. When the jet drive is installed on the vessel, the assembly 104 will be re-installed in identical fashion, without the need of adjustment or alignment of the linkages. A left control rod 106 and right control rod 107 are supported by linear bearings 108 and are provided with water seals 109 on the rearward ends to prevent water entry into the bearings and the vessel. Said control rods are pivotally connected to the left and right steering/reverse deflectors 86 and 87 via linkages 110 and rod end bearings 105. The forward ends of said control rods are pivotally linked to a bell crank 111, via linkages 112. Actuation, of said bell crank by steering cylinder 113, will cause the deflectors 86 and 87 to turn in unison, thereby providing steering action with the vessel in general forward movement. The bell crank pivot pin 114 is attached to a sliding base 115, slidably supported on two rods 116, that are rigidly attached to forward flange 84 of impeller housing 1, by means of stiffener rods 134 and back plate 135, permitting said base to slide along an axis in parallel to the control rods 106 and 107. The sliding base 115 is actuated by reverse control cylinder 117 and when it is moved in rearward direction, the deflectors 86 and 87 close to the reverse position and coil spring 118 maintains a controlled closing force. Steering action in reverse is obtained by actuation of the bell crank 111, by steering cylinder 113. A neutral position may be found by moving the sliding base 115 to a position between forward and reverse, until the thrust generated by forward and reverse flow balances. In addition, the reverse cylinder 117 may move sliding base 115 all the way forward to the park position, pulling both control rods 106 and 107 all the way forward, so that no surface of said rods, that forms a sealing surface for the water seals 109 is exposed to marine growth, during extended periods of non-use of the vessel.

In another embodiment, the sliding base 115 may be replaced with a base disposed in the same approximate position, but supported pivotally about a vertical axis, approximately the same distance forward of the transom as the bell crank pivot bolt 114 and more than the bell crank radius to either side of the jet drive centerline. The pivot support is rigidly mounted to the forward mounting flange 84 of impeller housing 1. The travel of bell crank pivot pin 114 in this embodiment will describe an arc with little deviation from the straight line, produced by slide 115. The linkages 112, pivotally attached to control rods 106 and 107 will compensate for said deviation.

Figure 8:
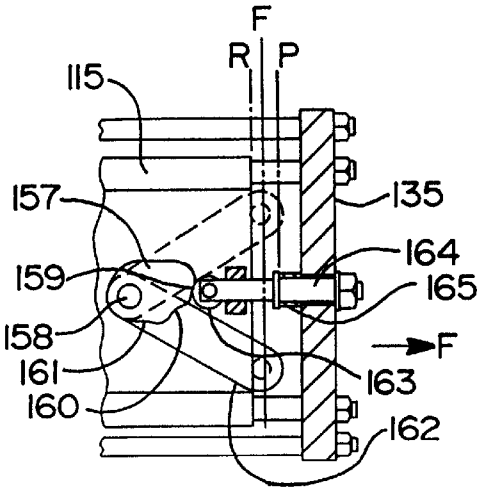
FIG. 8 is a fragmentary plan view of the invention showing details of an alternate, mechanical reverse control mechanism.

In another embodiment, the forward, reverse and park control may be cam operated as shown in FIG. 8. A cam 157 is disposed rotatively about a vertical pin 158 on sliding base 115 and has dimples 159, 160 and 161, placing said sliding base in reverse, forward and park as identified by R, F, and P. Cam 157 is rotated by lever 162, connected to an operating means. Cam follower 163 is attached to push rod 164, supported by back plate 135 and is spring loaded with spring 165, providing a pressure load to maintain the steering/reverse deflectors 86 and 87 closed in the reverse position. Springs 166 provide cam loading for the forward and reverse positions, as shown in FIGS. 5 and 6.

The jet drive way further include left and right steering vanes 102 and 103, each attached to the outboard surfaces of reverse ducts 96 and 97 respectively, as seen in FIGS. 1, 2, 3, and 6. The rudders are disposed in the vertical plane, parallel with the vessel keel line K when the deflectors 86 and 87 are positioned for straight forward movement of the vessel. The steering action will as a result also cause the rudders to articulate in the desired direction. Steering vanes 102 and 103 may be attached rigidly or pivotally, with a shear bolt or with shear bolts only, to prevent damage to the reverse ducts 96 and 97 in case the rudders strike a solid object, so that they can break away or rotate out of the way.

The jet drive includes a nozzle housing 8 with therein disposed inserts 121 and 122, held in place on the upper and lower walls of said nozzle housing by suitable fasteners, to alter the aperture of jet nozzle discharge port 85, without the need to change the complete nozzle housing 8. A jet stream directional trim may be obtained by selecting inserts 121 and 122 in selected thicknesses and profiles, to obtain said trim.

Alternately, moving inserts 123 and 124 may be placed in nozzle housing 8, pivotally supported in the upper and lower interior walls so as to allow actuation via push rod 125, rocker 126, control rod 127 and cylinder 128, from inside the vessel to adjust the degree of deflection of the inserts 123 and 124. By moving both inserts 123 and 124 inward or outward together, the aperture is controlled. By moving said inserts together in parallel, a trim action of the water jet stream up or down is obtained. The cylinder 128 is directly fastened to flange 84 of impeller housing 1. A water seal 109 prevents water from entering the vessel, where rod 127 passes through flange 84. In the park mode P, the control rod 127 is moved in the forward most position, to prevent marine growth from attaching itself to the sealing surface of said rod.

Also included in the jet drive design is a reverse/trim plane 101, pivotally attached to the transom T, by hinge 130, below the jet drive, to prevent forward flowing water from reverse ducts 96 and 97 from hitting transom T and to favorably influence the performance of the vessel while moving forward. Hydraulic cylinders 131 position said reverse/trim plane during forward operation. A hydraulic valve 132 with roller actuator 136, mounted on the steering/reverse control back plate 135 is operated by cam 133, attached to sliding base 115 and causes the cylinders 131 to retract fully, when shifted in reverse. In forward mode the reverse/trim plane resumes its adjusted trim position, as hydraulic valve 132 is actuated by the forward movement of sliding base 115, via actuator 136 and cam 133.

The reverse/trim plane cylinders have a park position similar to the steering/reverse control rods, whereby the actuating cylinders 131 are in the fully retracted position, to prevent marine growth on the rod surfaces during protracted times of inactivity. When the slide base 115 moves all the way forward in the park position P, valve 132 is again actuated, causing the retraction of cylinders 131.

As described above, a neutral thrust position of the deflectors can be found, by moving sliding base 115 in between the forward and reverse positions. However, always a slight movement will be experienced, as the balancing may not be constant or accurate, requiring steering station attendance as long as the engine is running. A true neutral position may be obtained by the use of a centrifugal clutch 137, mounted on the output shaft of the engine 7, automatically disengaging the jet from the engine at idle speeds. In the park mode of the steering/reverse slide 115, a linkage 138, operating a control lever 139 to the clutch 137 prevents said clutch from engaging at any engine speed so that the engine 7 may be started without engaging the jet at higher warm-up speeds. During emergency handling, if the need occurs to move from forward to reverse in quick order, the centrifugal clutch 137 will remain engaged, as the engine speed never returns to idle.

The jet drive according to the invention may also be prevented from causing movement in neutral position of deflectors 86 and 87, by admitting air to the intake duct 10 in a location near the impeller 3, by using a valve (not shown) to control the admission of said air. The aeration causes the impeller to stop pumping water, when engine is at idle, so preventing vessel movement. At higher engine speeds, the admission of air to the intake duct, will lower the engine load from the jet drive and will allow the jet drive to operate at reduced power, when engine power is needed to operate other devices on the vessel, such as fire pumps, bilge pumps, hydraulic pumps, while maneuvering control of the vessel is required.

According to the invention, the jet drive may further include an intake duct 10, with disposed at the rearward end an intake flange 2. Said intake duct is attached to the vessel for the transmission of all thrust, steering and reversing forces, generated by the jet drive and may be incorporated as a part of said vessel.

The intake duct 10 may have a raised trailing edge 140 which produces a decrease in apparent intake opening as the vessel speed increases, so reducing the flow of water into said intake duct at higher velocities while not affecting the water intake opening at low speeds. The surface 141 between the trailing edge 140 and the transom T is slanted down in rearward direction as the result of the raised position of said trailing edge. It serves to provide added lift at planing speeds and transom continuity for the reverse/trim plane 101 adjacent to it.

Figure 10:
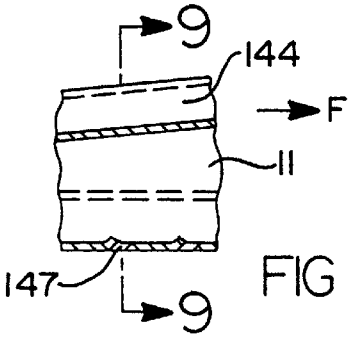
FIGS. 9 and 10 show fragmentary elevational end view and cross section of the invention showing the grid bars with fluid discharge apertures.
Figure 9:
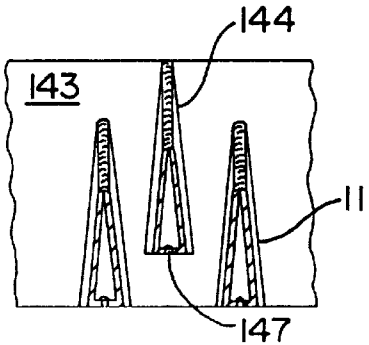

The marine jet drive may further include a plurality of grid bars 11 in the water intake duct, which are disposed in the vertical plane and parallel with the axis of rotation of impeller 3 and may be fastened to the intake duct upper wall 47 with a flange plate 143. The grid bars may advantageously be rearwardly tapered in vertical horizontal and longitudinal section, as shown in FIGS. 9 and 10, and may be stub ended in order to provide an increased clearance as debris moves aft along or through the bars, denying it all opportunity to wedge and plug the grid. As a further feature, the grid bars may be staggered in the vertical plane, by placing grid bars 144 higher up on flange plate 143, to stop wedging of larger debris between the lower bars 11. As described above, the intake duct trailing edge 140 is raised and the grid bars 11 and 144 way not be attached to said trailing edge but way be stub ended below and rearward of said trailing edge, preventing debris from lodging against said trailing edge.

The grid bars may have hollow interiors connected to a compressed fluid source via a plenum chamber 145, formed by the grid bar flange plate 143 and a recess in the upper surface 47 of the intake duct 10. A plurality of apertures in the grid bars admit the pressurized fluid to the exterior surfaces for clearing debris clinging to the grid bars. A suitable fluid conductor (not shown) may connect the space of high water pressure behind the impeller blades 14 to the plenum 145, as a pressurized fluid source. Alternately, an accumulator may discharge fluid under high pressure into the plenum 145 to quickly free any debris that may have lodged in the grid bars. Similarly, the trailing edge 140 may be provided with a tubular manifold 146 with a plurality of apertures 147, to clear said trailing edge of debris by means of high pressure fluid. The manifold 146 may be in fluid communication with the plenum chamber 145 of the grid bars.

According to another feature of the instant invention, pressurized fluid from the area behind the impeller blades 14 may be advantageously used to prime other pumps on board said vessel that would not prime on their own, such as other jet drives, ballast pumps, bilge pumps, or fire pumps. A fluid conductor (not shown) which may have a valve to control the flow in said fluid conductor, admits said pressurized fluid to the suction side of said other pumps.

The instant invention also provides for the lubrication of the bearings 26, 27 and 28 by means of oil supply port 148 and oil drain port 149, that pass through the uppermost and lowermost stator vanes 18 and thence through the impeller housing 1 via flange 84 and transom flange 2 to the vessel's interior. Fluid conductors 150 and 151 connect ports 148 and 149 to the oil reservoir 152, placed well above water line W. Self sealing disconnect fittings 156 are placed on flange 84 of impeller housing 1, connecting ports 148 and 149 with fluid conductors 150 and 151 respectively, to prevent oil spillage when conductors 150 and 151 are removed from self sealing disconnect fittings 156.

According to the instant invention there is a provision for the quick removal and re-installation of the jet drive assembly disposed generally behind the transom flange 2, including impeller housing 1, diffusor housing 4, nozzle housing 8, inner housing 5 and impeller 3, with all attachments thereto. Upon release of the impeller housing flange 84 from the transom flange 2, by removing fasteners, not shown, and the disconnecting of oil conductors 151 and 152, the removal in rearward direction causes the snap action locking feature generally at interface 59 of the forward water seal cartridge 51 to release and the spline connection 40 at driven flange 44 of the drive shaft 6 to release, so that the complete outboard portion of the jet can be removed. By positioning the removed assembly with impeller axis in vertical position, the debris cutting device 53, the water seal cartridge 51, the impeller 3, the wear ring insert 15, the labyrinth seal 75 the water seal 71, oil seal 70, emergency seal 76 and drive shaft seal 82 may now be serviced without the need of further jet drive disassembly or drainage of lubricating oil. Reversely, the re-installation of the jet drive assembly can be accomplished quickly after inspection and/or overhaul. Said removal and re-installation can be accomplished with the vessel in the water, by providing special covers (not shown), closing off the forward opening of shaft sleeve 46 around drive shaft 6 as well as around the lubricating oil self sealing disconnect fittings 156 and void space drain passage 69 protruding through the intake flange 2, before removal of the jet assembly.

Furthermore, because the impeller housing 1, the diffusor housing 4 and the nozzle housing 8 are always joined together and some of the features of the instant invention permit the alteration of the primary characteristics of the jet drive, such as the impeller diameter and impeller outer profile, the exhaust tube size and the nozzle discharge aperture, said three components may be manufactured as one single component, eliminating the joints between them, so reducing the need for flanges, fasteners and reducing the weight and cost of manufacture.

I claim:

1. In an improved marine jet drive for propelling a vessel with a forward and a rearward end, a driving means including an engine, an impeller, a drive shaft coupling the driving means to the impeller, an impeller housing around the impeller, a diffusor housing attached to the impeller housing, a nozzle housing attached to said diffusor housing and an intake duct disposed in front of said impeller housing, the improvement comprising:

(a) an inner housing, the inner housing disposed inside said diffusor housing and rotatively supporting the impeller;

(b) a rear flexible coupling disposed within the inner housing, the rear flexible coupling flexibly connecting the impeller to the drive shaft; and (c) a forward flexible coupling, the forward flexible coupling flexibly connecting the driving means to the drive shaft.

2. The improved marine jet drive of claim 1 wherein the inner housing is rigidly attached to the diffusor housing by a plurality of radially disposed stator vanes, at least one of said stator vanes being hollow for fluid communication through the inner housing.

3. The improved marine jet drive of claim 2 wherein the rear flexible coupling further comprises:

(1) the impeller having at least one key for connection to the drive shaft.

4. The improved marine jet drive of claim 2 wherein the rear flexible coupling further comprises:

(1) a drive shaft tube, the drive shaft tube having at least one key for connection to the impeller, and (2) the drive shaft flexibly connected to the drive shaft tube.

5. The improved marine jet drive of claim 2 wherein the drive shaft is enclosed within a shaft sleeve, the shaft sleeve being supported within the intake duct.

6. The improved marine jet drive of claim 5, further comprising a debris cutting device mounted to the impeller.

* * * * *

UNITED STATES PATENT AND TRADEMARK OFFICE

CERTIFICATE OF CORRECTION

PATENT NO. : 6,045,418

DATED : April 4, 2000

INVENTOR(S) : Paul W. Roos

It is certified that error appears in the above-identified patent and that said Letters Patent are hereby corrected as shown below:

In column 5, line 63, cancel "nay" and insert --may--.
In column 5, line 66, cancel "lover" and insert --lower--.
In column 8, line 1, after "the" cancel "line" , (first occurrence), and insert --keel--.
In column 9, line 48, cancel "an" and insert --on--.
In column 10, line 36, cancel "at" and insert --a--.
In column 12, line 43, cancel"," and insert --.--.
In column 16, line 24, cancel "way" and insert --may--.

Signed and Sealed this

Tenth Day of April, 2001

*Attest:*

Nicholas P. Godici

NICHOLAS P. GODICI

*Attesting Officer*

*Acting Director of the United States Patent and Trademark Office*